US005155538A

United States Patent [19]

Monfalcone

[11] Patent Number: 5,155,538

[45] Date of Patent: Oct. 13, 1992

[54] AUTOMATIC MODE CHANGE TO ENHANCE DOCUMENT COPIER EFFICIENCY

[75] Inventor: Marietta Monfalcone, Rochester, N.Y.

[73] Assignee: Eastman Kodak Company, Rochester, N.Y.

[21] Appl. No.: 807,345

[22] Filed: Dec. 16, 1991

[51] Int. Cl.[5] ..... G03G 15/00

[52] U.S. Cl. ..... 355/313; 355/321; 271/288

[58] Field of Search ..... 355/313, 314, 319, 321, 355/309, 323; 271/287-290, 298, 301

[56] References Cited

U.S. PATENT DOCUMENTS

| | | | |
|---|---|---|---|
| 4,204,727 | 5/1980 | Tates | 355/323 |
| 4,444,491 | 4/1984 | Rinehart et al. | 355/323 |
| 4,627,710 | 12/1986 | Goetz | 355/314 |
| 4,855,788 | 8/1989 | Fujii | 355/313 |
| 4,924,275 | 5/1990 | Nelson | 355/319 |
| 4,934,681 | 6/1990 | Holmes et al. | 271/3 |
| 5,061,958 | 10/1991 | Bunker et al. | 355/309 X |

*Primary Examiner*—Joan H. Pendegrass
*Attorney, Agent, or Firm*—Warren W. Kurz

[57] ABSTRACT

In a document copying apparatus of the type having (a) a "spot" color capability, (b) an automatic document feeder and (c) a multibin sorter, the copier's logic and control unit is programmed to automatically switch from a "recirculation" mode, to which it defaults unless instructed otherwise, to a "sorter" mode in response to a signal indicating that at least one page of a multipage document being copied requires that a copy sheet be presented twice to an image transfer station to complete the copying thereof. As a result of this automatic change in operating modes, fewer "skip" frames need be introduced during the copying operation, thereby enabling the copier to produce multiple collated copies of the multipage document more efficiently.

8 Claims, 3 Drawing Sheets

AUTOMATIC MODE CHANGE TO ENHANCE DOCUMENT COPIER EFFICIENCY

BACKGROUND OF THE INVENTION

The present invention relates to the field of electrophotography. More particularly, it relates to improvements in electrophotographic copiers of the type which incorporate an automatic document feeder, a multibin sorter, and an "accent" or "spot" color feature by which, for example, certain selected document information can be color highlighted with respect to other document information on a copy sheet.

Electrophotographic document copiers are well known in the art. Many of them, especially those designed for high volume copying, include an automatic document feeder for serially presenting the individual pages of a multipage document to be copied to the exposure platen of the copier. Some of these copiers also include a multibin sorter for accumulating collated, multisheet copies or "sets" of the multipage original document.

In copiers having both a document feeder and a sorter attachment, the copier normally "defaults" to a "recirculation" mode in which the document feeder repeatedly circulates the individual pages of the multipage original, one page at a time, between a document supply tray and the exposure platen of the copier. In this mode, the copier's image recording section cooperates with said document feeder to produce a collated, multisheet copy of the multipage document for each circulation of the multipage document and to deliver such copies, one atop the other, to an external exit hopper.

In addition to the aforementioned "recirculation" mode, document copiers of the above type can be selectively operated in a "non-recirculation" or "sorter" mode, in which case the document feeder, upon presenting a document page to the copier's exposure platen, operates to maintain such page on the exposure platen while multiple exposures are made. The copier's image recording section produces and delivers one copy of each document page to a discrete bin of the sorter. In this manner, the feeder cooperates with the image recording section to produce a collated, multisheet copy of a multipage document in each of the bins comprising the multibin sorter.

As between the two modes of operation described above, the "recirculation" mode is usually the more preferred mode since, in the majority of copying jobs, the original document consists of a relatively small number of pages, e.g., less than twenty, and the operator usually prefers to receive the collated copies in a single output tray, rather than in a plurality of separate bins. Note, in either mode, the feeder can usually present one or both sides of each document page to the exposure platen for copying.

In U.S. Pat. Nos. 4,740,818 (Tsilibes et al.) and 4,963,932 (Horwath), there is disclosed document-editing apparatus by which a copier operator can, by means of an editing stylus or wand, designate certain pages or page portions of a multipage original which are to receive certain "special" treatment during the copying process. Such treatment may include, for example, the use of "accent" or "spot" color to highlight certain text or graphic information, or the use of a half-tone screen or special development bias to increase or decrease the contrast or density of selected portions of the image. The copier's logic and control (LCU) responds to the output of the editing apparatus, which indicates the page number and special treatment to be given to a particular document page, and adjusts the copying process accordingly.

U.S. Pat. No. 4,775,510 (M. J. Russel) discloses an electrophotographic document copier of the type which includes both a document feeder and apparatus for providing accent or spot color. In one embodiment, this copier uses an intermediate storage tray to temporarily store one or more copy sheets between successive presentations to an image transfer station where, during a first pass, a copy sheet first receives a toner image of one color and, during a second pass, receives a toner image of a different color. Upon receiving images of two different colors, the copy sheets are delivered to an "accessory unit" which, though not specifically mentioned, could be a multibin sorter.

To automatically produce multiple copies of a multipage original in which one or more pages is to be copied with accent color, the above-mentioned Russel copier could operate in either of two modes. In a recirculation mode, the copier would operate to serially present each original page to the copier's exposure platen for copying. While feeding those original pages that require no special treatment (i.e., no accent color), the copier operates in its normal fashion, making one copy of each original page presented to the copier's exposure station, and delivering the copy sheet to an external exit hopper. When, however, a document page requiring accent color is presented to the exposure platen, the feeder will allow such page to remain on the platen while two successive latent images are formed on the copier's recording element. Prior to developing the first image with toner of a first color (e.g., black), that portion of the image which is to be developed with an accent color (e.g., red toner) is selectively erased from the recording element. Similarly, before developing the second image with toner of the accent color, that portion of the image which is not to receive the accent color is erased. In order for one copy sheet to receive both of these toner images, the copy sheet feeding apparatus will feed the copy sheet from the image transfer station (where it received the first toner image), along an endless path leading through the intermediate storage tray and back to the transfer station so that it may receive the accent color image. Because this endless path is of such length that it requires several copy sheets to fill, there must be a suitable time delay between the formation of the two related successive images on the recording element. Typically, several image frames on the recording element will be skipped between these two images. This requirement for multiple "skip frames" each time a document page is encountered that requires accent color (or, for that matter, any other treatment that requires two presentations of the copy sheet to an image transfer station) translates to an inefficiency in the copying process, causing the copier to produce copies at less than full machine speed.

Rather than operating in a "recirculation" mode, the above copier of Russel might operate in a "sorter" mode in making multiple copies of the multipage original described. In this mode, each original page remains on the exposure platen until the requisite number of copies are made, and the copies of each different page are delivered to different bins. When a page requiring accent color is encountered, all copies of the first transferred image are delivered to the intermediate storage tray where they are temporarily stored until the time comes to receive the accent color image, whereupon they are returned to the copier's transfer station. When the number of copies desired is such that the endless path leading from the transfer station, through the intermediate tray and back to the transfer station is filled with copy sheets, there is no need for multiple skip frames, and the copier can operate at near full machine speed.

While the number of skip frames can be reduced by operating the copier described above in a "sorter" mode, the recognition of this fact is not readily apparent to the casual operator. Since, as noted above, copiers of this type will normally default to a "recirculation" mode unless instructed otherwise, there is a latent inefficiency in such copiers when confronted with a copying job of the type described.

From the foregoing discussion, an object of this invention is to overcome the latent inefficiency in using a copier of the above type to produce multiple collated copies of a multipage document in which at least one document page must be cycled past an image transfer station twice in order to complete a copying operation.

SUMMARY OF THE INVENTION

According to the present invention, there is provided a document copier of the above type which, in response to a signal indicating that at least one page of a multipage original document is to be copied in a manner that requires the copy sheet corresponding to such page to be presented to the image transfer station twice in order to receive multiple toner images which together constitute the desired image, assures that the copier operates in its "sorter" or "non-recirculating" mode, rather than its "recirculation" mode. As will be seen from the ensuing detailed description of preferred embodiments, this has the effect of substantially reducing the number of skip frames during the copying operation and, hence, increasing the copier efficiency in terms of throughput.

According to a preferred embodiment, there is provided a novel document copier of the type which is capable of selectively recording either one or two toner images on a single copy sheet, and of producing a desired plurality of collated, multisheet copies of a multipage original document containing at least one page which has been copied by recording two images on a single copy sheet. The document copier of the invention comprises:

a) an image-recording section including (i) a photosensitive recording element; (ii) an exposure station comprising an exposure platen for supporting a document page to be copied and optical means for projecting an image of a document page supported by the exposure platen onto said recording element to record a latent image thereon; (iii) a development station for selectively applying toner particles to said recording element to render said latent image visible; (iv) an image transfer station for transferring a toner image from said recording element to a planar surface of a copy sheet presented thereto; and (v) sheet-feeding means for presenting copy sheets seriatim to said transfer station to receive toner images from said recording element, said sheet-feeding means being normally operable in a first mode in which it operates to advance toner image-bearing copy sheets from said transfer station to an exit hopper, and being selectively operable in either a second mode in which it advances toner image-bearing copy sheets from the transfer station to a multibin sorter, or in a third mode in which it advances toner image-bearing copy sheets along an endless path leading back to said transfer station to enable a copy sheet moving therealong to receive a different toner image on the same or opposite planar surface as that which received the previous toner image;

b) a document feeder normally operable in a "recirculation" mode in which it operates to repeatedly circulate the individual pages of a multipage document, one page at a time, between a document supply and the exposure platen of said image recording section, such image recording section cooperating with the document feeder to produce a collated, multisheet copy of such multipage document for each circulation of the multipage document and to deliver such collated, multisheet copies to said exit hopper, such document feeder being selectively operable in a "sorter" mode in which it operates to advance the individual pages of a multipage document from a document supply to the exposure platen and cooperates with the image recording section to produce a collated, multisheet copy of such multipage document in each of a plurality of bins comprising the multibin sorter; and c) logic and control means for controlling the respective operating modes of said document feeder and sheet-feeding means, such logic and control means being responsive to a control signal, indicating that at least one sheet in a multisheet copy of a multipage document is to receive two separate toner images to complete a desired copying thereof, to cause the document feeder to operate in its "sorter" mode, and to cause the sheet-feeding means to operate in its second mode when advancing toner image-bearing copy sheets which need not receive an additional toner image to complete, and in its third mode when advancing toner image-bearing copy sheets which require an additional toner image to complete.

The invention will be better understood from the ensuing detailed description of preferred embodiments, reference being made to the accompanying drawings.

DETAILED DESCRIPTION OF PREFERRED EMBODIMENTS

Figure 1:
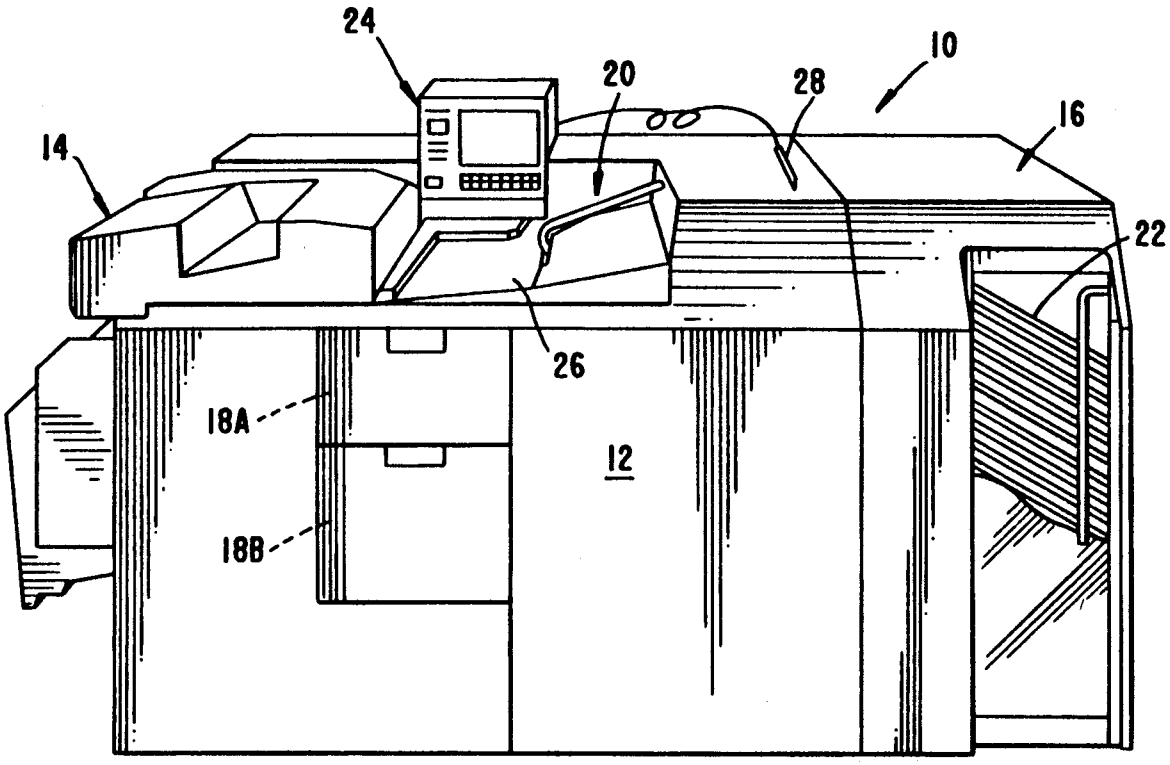
FIG. 1 is a perspective illustration of an electrophotographic document copier of the type in which the invention is useful.

Referring now to the drawings, FIG. 1 illustrates an electrophotographic document copier 10 which is adapted to copy image information on original document pages presented thereto for copying. Such copier comprises an image-recording section 12, a document feeder 14, and a multibin sorter attachment 16. Image-recording section 12 is adapted to record images on copy sheets contained in either of two sheet supplies 18A and 18B and to advance these copy sheets to either a top exit hopper 20, or to one of the bins 22 of the sorter attachment. The image-recording section operates under the instructions given by a copier operator via an operator control panel 24. An editing tablet 26 enables an operator to designate, via an electronic stylus or wand 28, which portion of an original document page is to receive "special treatment", e.g., spot color, screening, etc., in a copying operation.

Figure 2:
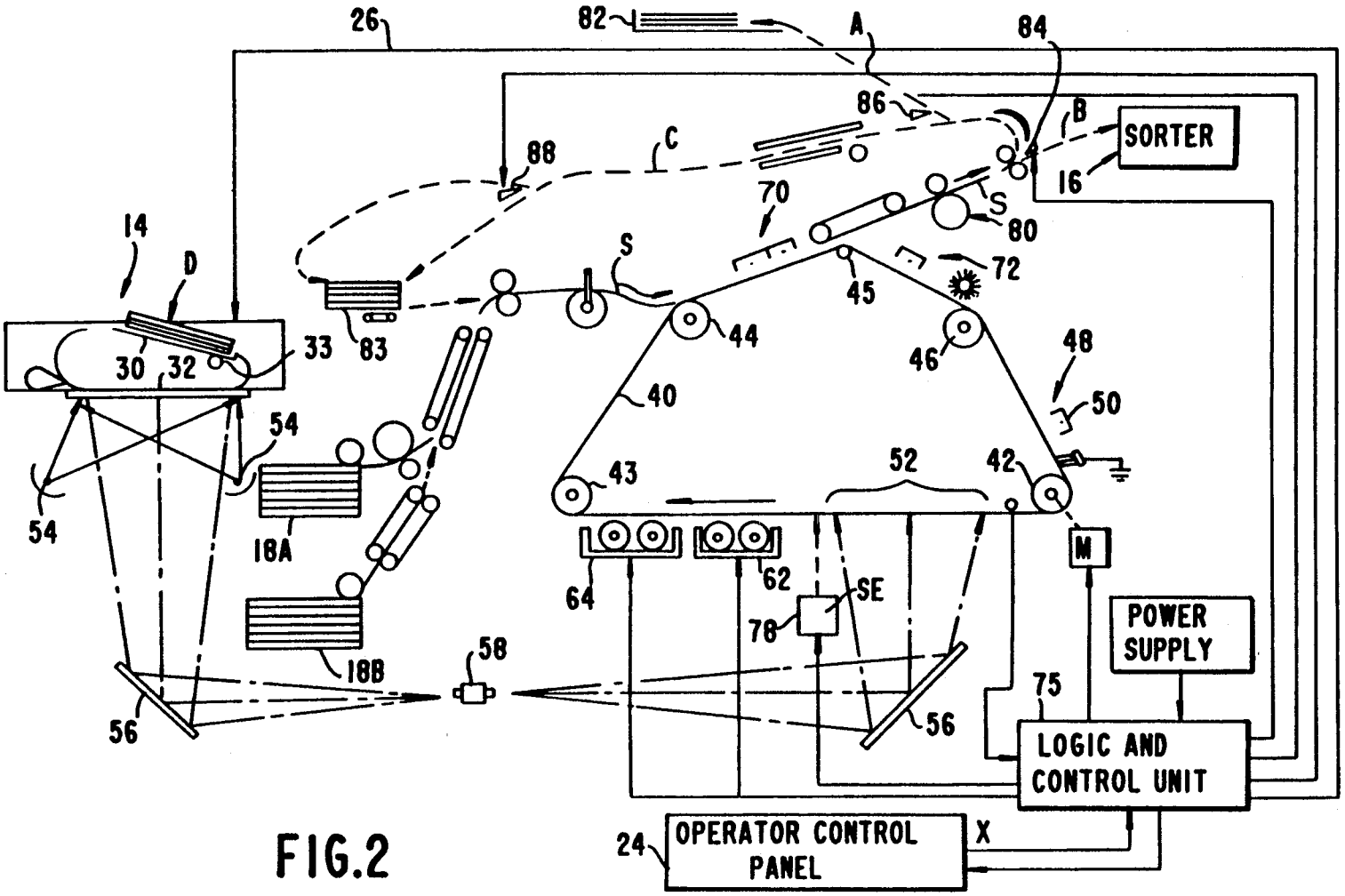
FIG. 2 is a schematic illustration of an electrophotographic copier embodying the present invention.

As better shown in FIG. 2, document feeder 14 comprises a document supply tray 30 for receiving a multipage document D to be copied, and sheet feeding means 33 for serially presenting the individual pages of the document to the exposure platen 32 of the image-recording section. Preferably, the document feeder is capable of operating in a duplex mode in which it operates to present both sides of each document page to the exposure platen for copying. Upon presenting each document page for copying, the document feeder returns the page to the supply tray. A suitable document feeder is disclosed, for example, in the commonly assigned U.S. Pat. No. 4,140,387 issued to G. Gustafson, the disclosure of which is incorporated herein by reference.

The image-recording section of copier 10 comprises an endless photoconductive recording element 40 which is guided along an endless path by rollers 42–46. Roller 42 is rotatably driven by a motor M to advance the recording element in the direction of the arrow. Positioned along the endless path of the recording element are the various processing stations which collectively act to form a transferable toner image on the recording element of image information on a document page presented to exposure platen 32. Briefly, such processing stations include a charging station 48 at which a corona charger 50 applies a uniform electrostatic charge to the photoconductive surface of the recording element, and an exposure station 52 at which an image of a document page is projected onto the charged surface of the recording element to form a developable charge image thereon. The exposure station typically comprises a pair of flashlamps 54 which briefly expose the document page on the exposure platen, and a pair of mirrors 56 and a lens 58 for projecting an image of the illuminated document page onto the recording element. The charge image on the recording element is developed with toner particles at one of two different development stations 62, 64. These stations are adapted to apply toner of different colors to the charge image to produce a "spot" or "accent" color effect on the final image, as explained below. The toner image on the recording element is then transferred to a copy sheet S which has been advanced from one of the two aforementioned sheet supplies 18A or 18B. Copy sheets are fed to a transfer station 70 in timed relationship with the arrival of the toner image. After having its toner image transferred therefrom, the recording element is cleaned of residual toner by a cleaning station 72, and the recording element is recycled through the electrophotographic process. The timing and control of the various processing stations of the entire copier is achieved through a microprocessor based logic and control unit or LCU 75.

The production of a spot color copy is well described in the aforementioned Russel and Tsilibes et al. patents, the respective disclosures of which are incorporated herein by reference. Briefly, spot color on a copy sheet is achieved by first having the operator identify that image portion on the original page that is to receive the different color toner. This can be done by either highlighting such portion with a special marker pen, as disclosed by Russel, or by using a special electronic editing tablet, as disclosed by Tsilibes et al. In the Russel approach, the highlighted document page(s) is placed in the document supply tray of the recirculating feeder 14 along with the other document pages constituting the multipage original. The operator then indicates, through a control switch on the operator control panel that this is a spot color job. The operator also indicates, via a numeric key pad, which page(s) in the stack require spot color. In the course of feeding original pages from the document supply tray to the copier's exposure platen, the pages pass over an image scanner that is sensitive to the highlighted portions. The location of the highlighted portions of each original are detected and stored in a bit map. Upon reaching the exposure platen, each original page requiring spot color is exposed twice for each copy desired, thereby producing two identical latent images on the recording element of the spot color original. Operating under the control of the LCU and the bit map produced by the image scanner, a selective erase device 78, such as an array of LED's or a scanning laser beam, operates to erase from one image frame only the highlighted portions of the electrostatic image, and to erase from the other image frame the non-highlighted portions. The two image frames are then developed with toners of different color, and the resulting toner images are transferred, one after the other, to a single copy sheet.

Upon receiving a toner image at transfer station 70, a copy sheet will be directed along one of three different sheet paths, all of which pass through a roller fusing station 80, which fuses the toner to the copy sheet. One path A leads from the transfer station to an external exit hopper 82, another path B leads from the transfer station to the multibin sorter attachment 16, and a third path C is an endless path leading from the transfer station, through an intermediate storage tray, and back to the transfer station. A pair of movable sheet deflectors 84, and 86, operate under the control of LCU 75 to control which of the three paths is used. Deflector 84, when activated, deflects copy sheets moving along a common portion of the three paths to the sorter, and deflector 86, when activated, deflects copy sheets moving along a common portion of paths A and C towards the intermediate storage tray 83. A third deflector 88 operates under the control of the LCU to direct copy sheets along either an inverting or non-inverting paths leading to tray 83, depending on whether the toner images are to be transferred to opposite sides of the copy sheet, as in the case of duplex copying, or on the same side of the copy sheet, as in the case of spot color.

As indicated earlier herein, in using copiers of the type described above to produce multiple collated copies of a multipage original in which at least one document page is to be copied with spot color, there is a latent inefficiency in operating in the "recirculation" mode, i.e., the mode to which the copier is commonly programmed to default unless otherwise instructed. With reference to FIG. 2, it will be appreciated that path C requires several copy sheets (e.g. 5 to 7 sheets) to fill. Thus, after a copy sheet receives a first toner image, there is a substantial time delay before it can be returned to the transfer station to receive a second image. This delay corresponds to the time it takes for a copy sheet to traverse the entire closed loop sheet path C. When the copier is operating in its "recirculation" mode, this time delay is encountered once for each "special" page circled by the feeder, and once for each circulation. Note, however, when the copier is operating in its "sorter" mode in which collated multisheet copies are delivered to each of the sorter bins of the sorter attachment, the copier can operate at full machine speed whenever the number of copies desired equals or exceeds the number of sheets required to fill the endless sheet path C. The following example will explain this difference in copying speed.

Assume it is desired to make seven collated copies of a five page original document. Also assume the copier is operating in its "sorter" (i.e. "non-recirculating) mode, and that page 3 is "special" in that it requires spot color to complete the copying thereof. The multipage original is placed in the feeder, face up, with page 1 on top. Since the feeder feeds pages from the bottom of the stack, it first circulates page 5 to the exposure station, whereupon seven exposures are made on seven consecutive image frames on the recording element. Copy sheets are fed to the transfer station to receive these seven images, one toner image per sheet, and the copy sheets are delivered to seven sorter bins, face up, one sheet per bin. Thereafter, page 4 is copied in the same fashion, and the copies thereof are delivered to the sorter in the same way, each copy of page 4 being delivered, face up, atop each copy of page 5. When "special" page 3 is fed to the exposure station, it remains there until fourteen images are made. In the first seven image frames, the selective erase device 78 is used to erase that portion of the electrostatic image corresponding to the spot color portions of the desired image. The resulting transferred images are transferred to copy sheets and these sheets are advanced along sheet path C for temporary storage in tray 83. Meanwhile, the selective erase device is used to erase all but the spot color portion of the next seven image frames, i.e., frames 8–14. As the eighth frame approaches the transfer station, the first-stored copy sheet in tray 83 is advanced toward the transfer station to receive the spot color image. This process continues until the spot color copy sheets are stored in the sorter bins, and the remaining two document pages are copied as described above with reference to page 1.

The point of the above discussion is that, when copying documents of the type described, the copier is substantially more efficient, in terms of speed, when operating in the sorter mode. Yet, for reasons mentioned above, the copier logic commonly defaults to the "recirculation" mode, thereby preventing this speed advantage.

According to the invention, the advantage of operating in the "sorter" mode for copying jobs of the type described is "recognized" by the copier's LCU, and the mode is automatically switched from the "recirculation" mode, to the "sorter" mode. When an operator selects "spot color" on the operator control panel 24, or, for that matter selects any control switch which indicates that any document page requires two toner images to complete the desired copying job (and this includes duplex or two-sided copying), a control signal X is produced. The copier's microprocessor-base control unit responds to this control signal to assure that the copier is operating in "sorter" collation mode. The flow-chart of FIG. 3 illustrates the steps in the program for achieving this result.

Figure 3:
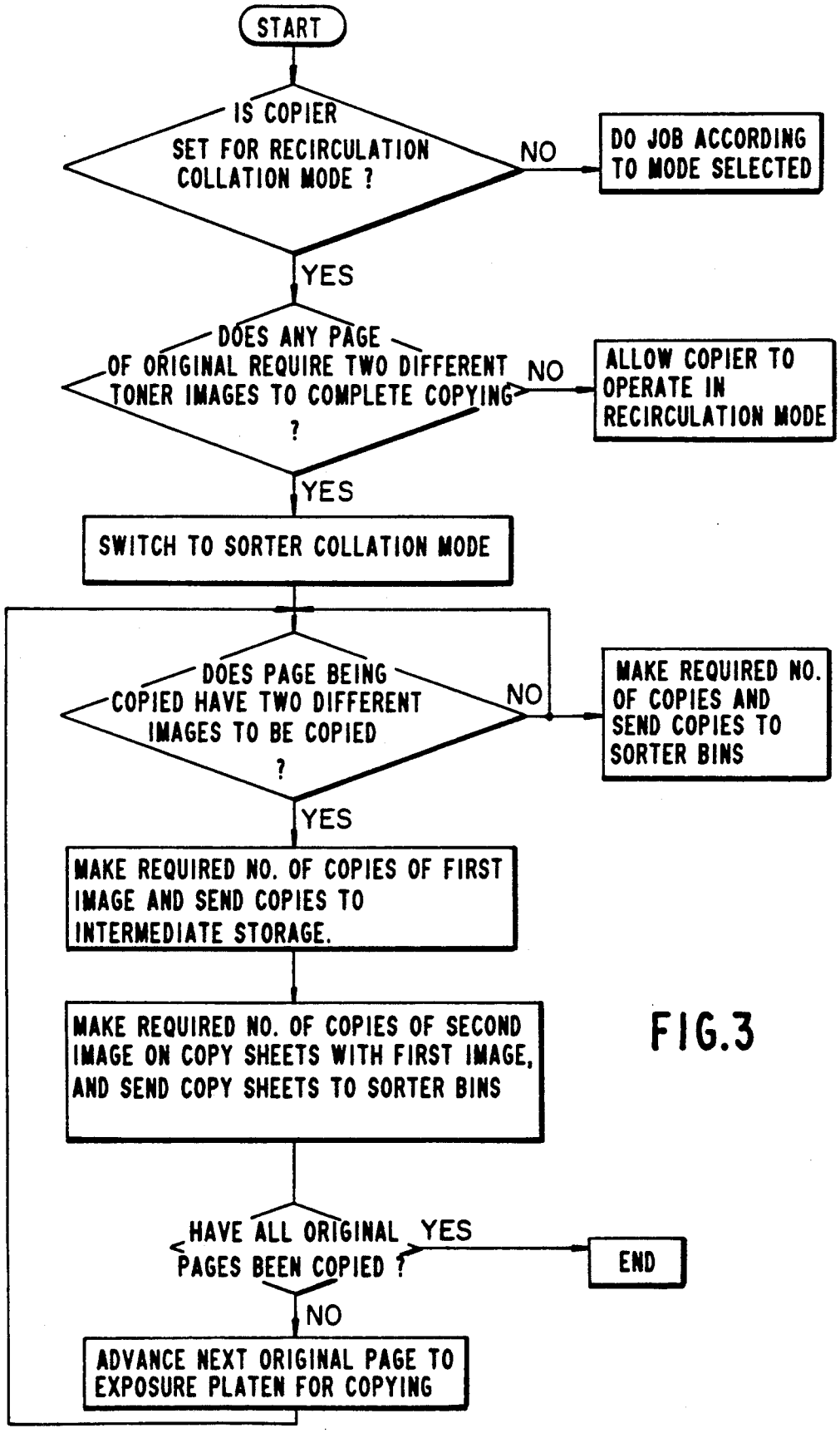
FIG. 3 is a flow chart indicating a series of steps carried out by the logic and control unit of the copier of FIG. 2.

Referring to FIG. 3, if the copier is already set to operate in a non-recirculating mode, then the job is performed according to that setting. If the copier is set for its recirculation mode, the question is whether any page in the document being copied requires two toner images to complete the copying thereof. Such would be the case where one or more pages requires spot color, or where one page has is a duplex page (having images on both sides thereof. The presence or absence of control signal X from the operator control panel answers this question. If no "special" document page is present, the copier is allowed to operate in the recirculation mode. If, however, the answer to this question is "yes", then the copier mode is switched to the "sorter" collation mode, and the pages are considered on a page-by page basis. In the case of non-special pages, the LCU controls the copier as described above, and positions deflector 84 to divert copy sheets to the sorter. If the page being copied has two image portions to be copied, the LCU directs the copier to copy the first image and to divert the copy sheets to tray 83, along path C. The LCU then directs the copier to produce a toner image of the second image portion and to advance the copy sheets from tray 83 to receive it. After all document pages have been copied as described, the program ends.

The invention has been described in detail with particular reference to a preferred embodiment thereof, but it will be understood that variations and modifications can be effected within the spirit and scope of the invention.

What is claimed is:

1. A copier/duplicator comprising:

a) an image recording section including (i) a photosensitive recording element; (ii) an exposure station comprising an exposure platen for supporting a document page to be copied and optical means for projecting an image of a document page disposed on the exposure platen onto said recording element to record a latent image thereon; (iii) a development station for selectively applying toner particles to said recording element to render said latent image visible; (iv) an image transfer station for transferring a toner image from said recording element to a planar surface of a copy sheet presented thereto; and (v) sheet-feeding means for presenting copy sheets seriatim to said transfer station to receive toner images from said recording element, said sheet-feeding means being normally operable in a first mode in which it operates to advance toner image-bearing copy sheets from said transfer station to an exit hopper, and being selectively operable in either a second mode in which it advances toner image-bearing copy sheets from the transfer station to a multibin sorter, or in a third mode in which it advances toner image-bearing copy sheets along an endless path leading back to said transfer station to enable a copy sheet moving therealong to receive a different toner image;

b) a document feeder normally operable in a "recirculation" mode in which it operates to repeatedly circulate the individual pages of a multipage document, one page at a time, between a document supply and the exposure platen of said image recording section, said image recording section cooperating with said document feeder to produce a collated, multisheet copy of such multipage document for each circulation of the multipage document and to deliver such collated, multisheet copies to said exit hopper, said document feeder being selectively operable in a "sorter" mode in which it operates to advance the individual pages of a multipage document from a document supply to said exposure platen and cooperates with said image recording section to produce a collated, multisheet copy of such multipage document in each of a plurality of bins comprising said multibin sorter; and c) logic and control means for controlling the operating mode of said document feeder and sheet-feeding means, said logic and control means being responsive to a signal indicating that at least one sheet in a multisheet copy of a multipage document is to receive toner images of two different colors to cause the document feeder to operate in its "sorter" mode, and to cause said sheet-feeding means to operate in its second mode when advancing toner image-bearing copy sheets which need not receive an additional toner image to complete, and in its third mode when advancing toner image-bearing copy sheets which require an additional toner image to complete.

2. The apparatus as defined by claim 1 wherein said signal is provided by an operator control panel.

3. The apparatus as defined by claim 1 wherein said logic and control unit comprises a microprocessor programmed to cause said document feeder to operate in its "sorter" mode and to cause said sheet-feeding means to operate in its second and third modes, as described, in response to said signal.

4. A copier/duplicator of the type which is capable of selectively recording image information on copy sheets in either or both of two different colors, and of producing a desired plurality of collated, multisheet copies of a multipage original document, said copier/duplicator comprising:

a) an image recording section including (i) an exposure platen for supporting a document page to be copied; (ii) optical means for projecting an image of a document page disposed on the exposure platen onto a photosensitive recording element to record a latent image thereon; (iii) a development station for selectively applying toner particles of either of two different colors to said recording element to render said latent image visible; (iv) an image transfer station for transferring a toner image from said recording element to a planar surface of a copy sheet presented thereto; and (v) sheet-feeding means for presenting copy sheets seriatim to said transfer station to receive toner images from said recording element, said sheet-feeding means being normally operable in a first mode in which it operates to advance toner image-bearing copy sheets from said transfer station to an exit hopper, and being selectively operable in either a second mode in which it advances toner image-bearing copy sheets from the transfer station to a multibin sorter, or in a third mode in which it advances toner image-bearing copy sheets along an endless path leading back to said transfer station to enable a copy sheet moving therealong to receive a different color toner image on the same planar surface as that which received the previous toner image;

b) a document feeder normally operable in a "recirculation" mode in which it operates to repeatedly circulate the individual pages of a multipage document, one page at a time, between a document supply and the exposure platen of said image recording section, said image recording section cooperating with said document feeder to produce a collated, multisheet copy of said multipage document for each circulation of the multipage document and to advance the copy sheets of such multisheet copies to said exit hopper, said document feeder being selectively operable in a "sorter" mode in which it operates to present each page of a multipage document to the exposure platen only one time for copying, said image recording section cooperating with said document feeder to produce a collated, multisheet copy of said multipage document in each of a plurality of sorter bins comprising said multibin sorter; and c) logic and control means for controlling the operating mode of said document feeder and sheet-feeding means, said logic and control means being responsive to a signal indicating that image information on at least one page of said multipage document is to be copied in two different colors to cause the document feeder to operate in its "sorter" mode and to cause said sheet-feeder to operate in its third mode when advancing those copy sheets which are to receive toner images of two different colors.

5. The apparatus as defined by claim 4 wherein said signal is provided by an operator control panel.

6. The apparatus as defined by claim 4 wherein said logic and control unit comprises a microprocessor programmed to cause said document feeder to operate in its "sorter" mode and to cause said sheet-feeding means to operate in its second and third modes, as described, in response to said signal.

7. Copying apparatus comprising:

(a) means for selectively copying a multipage document onto copy sheets in either one color or two different colors;

(b) means defining first and second exits through which copy sheets can exit from the copying apparatus (c) default means for causing copy sheets to normally exit the copying apparatus through said first exit; and (d) means responsive to a control signal indicating that a portion of at least one page of the multipage document is to be copied in a color different from the remaining portion to cause all copy sheets of that document to exit from the copying apparatus through said second exit.

8. Image-reproduction apparatus of the type which is capable of selectively recording image information on a copy sheet by presenting such copy sheet to an image transfer station either once or twice, said apparatus comprising:

(a) means defining first and second exits through which copy sheets can exit from the apparatus (b) default means for causing copy sheets to normally exit the apparatus through said first exit; and (c) means responsive to a control signal indicating that image information is to be recorded on a copy sheet in two presentations of such copy sheet to an image transfer station to cause such copy sheet to exit from the copying apparatus through said second exit.

* * * * *